US005494274A

United States Patent [19]

Hansch

[11] Patent Number: 5,494,274

[45] Date of Patent: Feb. 27, 1996

[54] APPARATUS FOR FEEDING PRODUCTS, SUCH AS CARDS AND PRODUCT SAMPLES, TO A FURTHER PROCESSING POINT

[75] Inventor: Egon Hansch, Wetzikon, Switzerland

[73] Assignee: Ferag AG, Hinwil, Switzerland

[21] Appl. No.: 462,792

[22] Filed: Jun. 5, 1995

Related U.S. Application Data

[62] Division of Ser. No. 267,122, Jun. 27, 1994.

[30] Foreign Application Priority Data

Jun. 29, 1993 [CH] Switzerland ..... 01948/93

[51] Int. Cl.[6] ..... B65H 3/44

[52] U.S. Cl. ..... 271/9.02; 271/9.03; 271/9.08; 271/12; 271/107; 271/30.1; 271/277; 271/157

[58] Field of Search ..... 271/9.03, 9.02, 271/9.12, 9.08, 11, 12, 107, 30.1, 31, 31.1, 277, 204, 145, 10, 15, 162, 147, 157; 270/58

[56] References Cited

U.S. PATENT DOCUMENTS

| | | | |
|---|---|---|---|
| 2,589,428 | 3/1972 | Pearce | 271/30.1 |
| 3,115,991 | 12/1963 | Carew et al. | 221/198 |
| 4,067,458 | 1/1978 | Schneider et al. | 271/9.12 |
| 4,127,262 | 11/1978 | Eberle et al. . | |
| 4,251,010 | 2/1981 | Schmeykal et al. . | |
| 4,279,412 | 7/1981 | Glatz . | |
| 4,451,191 | 5/1984 | Torre | 271/9.08 |
| 4,504,053 | 3/1985 | Shiozawa | 271/157 |
| 4,703,924 | 11/1987 | Marass . | |
| 4,763,890 | 8/1988 | Zimmerman et al. | 271/9.08 |
| 4,930,291 | 6/1990 | Boisseau . | |
| 4,953,847 | 9/1990 | Honegger . | |
| 5,042,792 | 8/1991 | Honegger et al. . | |
| 5,046,617 | 9/1991 | Focke et al. . | |
| 5,096,179 | 3/1992 | Schmitt . | |
| 5,137,269 | 8/1992 | Yamamoto . | |
| 5,231,930 | 8/1993 | Focke et al. . | |
| 5,297,923 | 3/1994 | Boriani et al. | 271/9.03 |
| 5,388,820 | 2/1995 | Eberle et al. . | |
| 5,395,151 | 3/1995 | Eberle | 271/277 |
| 5,425,837 | 6/1995 | Hansch | 271/277 |

FOREIGN PATENT DOCUMENTS

| | | |
|---|---|---|
| 0313294 | 4/1989 | European Pat. Off. . |
| 720688 | 5/1942 | Germany . |
| 2135303 | 8/1973 | Germany . |
| 419191 | 8/1966 | Switzerland . |
| 1429887 | 3/1976 | United Kingdom . |
| 2101099 | 1/1983 | United Kingdom . |
| 2260123 | 4/1993 | United Kingdom . |

*Primary Examiner*—H. Grant Skaggs
*Attorney, Agent, or Firm*—Bell, Seltzer, Park & Gibson

[57] ABSTRACT

An apparatus for feeding products, such as cards and product samples to a further processing point is disclosed. The apparatus has a magazine device which has at least two magazine compartments and a conveying device having successive grippers which travel over the magazine device. During a certain time period, a transporting member corresponding to one of the magazine compartments is activated so that it feeds products contained in the compartment one after another to the grippers as the grippers travel over the compartment. At a desired point in time, the active transporting member is deactivated and a transporting member corresponding to another magazine compartment is activated in order that uninterrupted operation is provided. While the subsequent magazine compartment is in operation, the previously active compartment can be moved from its working position and resupplied with products.

12 Claims, 7 Drawing Sheets

APPARATUS FOR FEEDING PRODUCTS, SUCH AS CARDS AND PRODUCT SAMPLES, TO A FURTHER PROCESSING POINT

This application is a divisional of application Ser. No. 08/267,122, filed Jun. 27, 1994.

BACKGROUND OF THE INVENTION

The present invention relates to an apparatus for feeding products, such as cards and product samples which are intended to be inserted into or stuck onto printing products, to a further processing point.

An apparatus of this type is disclosed in DE-A-2135303. A stack of products, such as paper bags, plastic bags, tin-foil pockets or postcards, is arranged in a vertical magazine compartment, and then the products are removed individually. For this purpose, the apparatus has a conveying device with a drawing member which is driven in a circulating manner and on which there are arranged one behind the other two applying heads, each of which has a gripping mechanism. The gripping mechanisms serve to remove the products from the magazine compartment and securely hold the products until the applying heads are set onto a printing product onto which the product is to be stuck. This known apparatus is likely to be suitable only for low operating speeds. The products are removed by means of the gripping mechanisms from the bottom of the upright stack. This results in correspondingly great accelerations and on the other hand the forces acting on the products are further increased by the entire weight of the stack resting on the product to be removed. This results in extremely great stressing of the products, in particular if they are product samples filled with liquid.

It is therefore an object of the present invention to provide an apparatus of the generic type which, while treating the products gently, ensures uninterrupted operation at high processing speed.

SUMMARY OF THE INVENTION

The object as stated above, among others, is achieved by an apparatus which allows for the removal of the products to be fed (such as cards and product samples) from the top of magazine-held upright product stacks or from horizontal magazine compartments and therefore avoids the imposition of forces as discussed above. According to the invention, there is a magazine device having at least two magazine compartments from which products are removed one at a time during a respective time period and are transferred to the grippers of a conveying device. This makes it possible for stacks to be reduced by gentle removal from the top of product stacks held in upright magazine compartments or else from horizontal magazine compartments. The magazine device, in its preferred form, has at least two magazine compartments in order that the product removal operation can continue in uninterrupted fashion. In this form, both magazine compartments are utilized so that once the stack in one magazine compartment has been reduced, the products can be removed from the other magazine compartment, it being possible for the first-mentioned magazine compartment to be simultaneously filled again with a product stack. The products are removed from the respective magazine compartment by means of a transporting member and are introduced into the mouth of a gripper. This permits gentle treatment of the products even at very high processing speed, since the accelerations and forces acting on the products can be kept small. Furthermore, the space requirement is reduced to a minimum and the magazine compartments are accessible without any problems, since the conveying device leads away over the magazine compartments.

The apparatus according to the invention is suitable in particular for feeding the products to a further processing station, such as is described in the earlier Swiss Patent Application No. 00107/93-2 and the corresponding U.S. application Ser. No. 08/173,967, now U.S. Pat. No. 5,425,837. There, the products are taken over from the grippers of the conveying device by take-over grippers arranged on a wheel-like carrying member and, by means of these, are stuck onto printing products or inserted into the latter, the printing products being located in pocket-shaped receiving parts or on saddle-shaped supports of a processing drum. It would also be possible by means of the conveying device according to the present invention for the products to be inserted directly into printing products or for bound-in inserts to be deposited in the opened state onto collecting lines. Numerous embodiments are readily achievable according to the present invention, as will be discussed herein.

A particularly space-saving embodiment of the apparatus according to the invention is the embodiment depicted in FIG. 3, which shows an arrangement wherein the mouths (40) of the grippers (30) are aligned pointing rearward and obliquely downward with respect to the conveying direction (F) and the transporting members (34) are moved in a direction so that the product being fed to grippers (30) is moved in the conveying direction (F) and at an angle obliquely upward of the conveying direction so that the product is readily fed into the mount (40) of the grippers.

A further preferred embodiment, as depicted in FIG. 1, for example, allows complete exposure of the respectively outermost product of a stack at the delivery point. As a result, only minimal forces act on this product when it is drawn from the stack. Moreover, during drawing off of the outermost product via the present invention, further products of the stack are not undesirably drawn along at the same time, as could occur with prior art devices. Further, with the product arrangement utilized by the present invention, a large area of the product is available for the transporting member to act upon.

A particularly simple and quick filling of the magazine compartments is ensured by the fact that they can be brought from a working position into a filling position in which they are freely accessible. Various configurations for this arrangement will be discussed infra with respect to FIGS. 2, 11 and 12.

A particularly high processing speed with extremely gentle treatment of the products is achieved through the use of vertical upright or inclined magazine compartments with the stacks being reduced by removal from above. In inclined magazine compartments, the stacks are held particularly securely.

Particularly preferred is an embodiment in which the transporting members each have a suction head, in order to seize the respectively outermost product of a stack and feed it to a gripper. The product can thereby be seized in a gentle way on its flat side.

Simple handling of the product stacks and, in particular, simple filling of the magazine compartments is achieved through the delivery of products in product supply units which are prepared stacks of products provided in lidless box-like containers.

BRIEF DESCRIPTION OF THE DRAWINGS

The present invention is now explained in more detail with reference to embodiments represented in the drawing, in which purely diagrammatically.

DETAILED DESCRIPTION OF THE DRAWINGS

Figure 1:
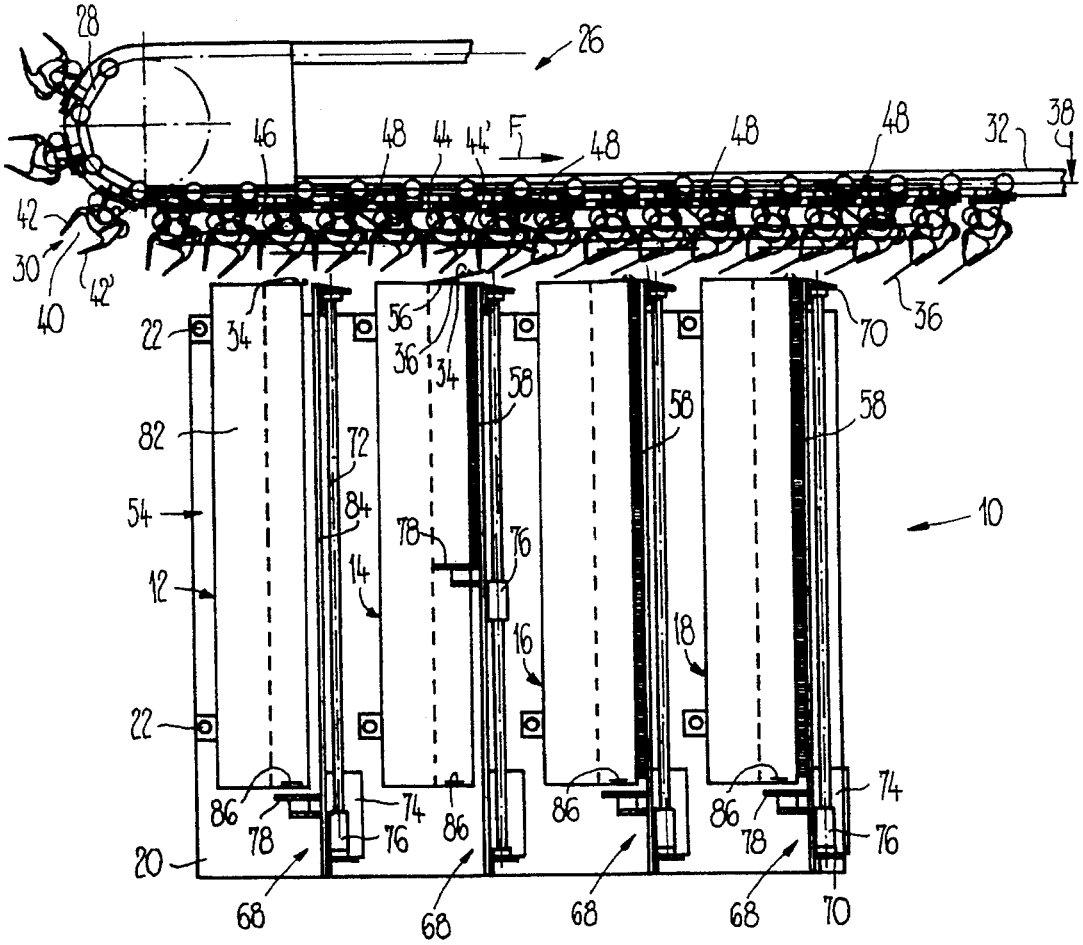
FIGS. 1 and 2 show in elevation and plan view, respectively, a first embodiment of the apparatus according to the invention with vertical magazine compartments and a conveying device leading away over the magazine compartments.
Figure 2:
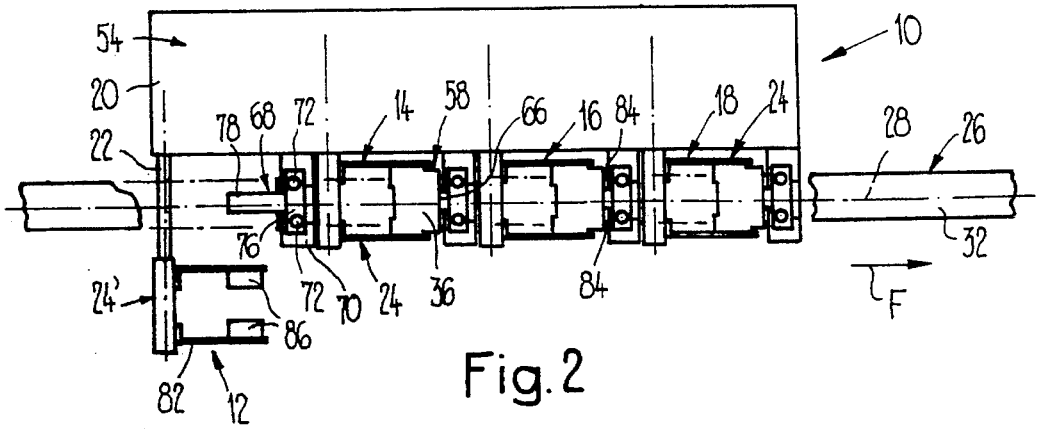

The apparatus according to the invention shown in FIGS. 1 and 2 has a magazine device 10 with four magazine compartments 12, 14, 16, 18 extending in the vertical direction. These are supported on a cabinet-like rack 20 in each case by means of two shanks 22 which run in the horizontal direction and are spaced apart in the vertical direction. As is evident in particular from FIG. 2, the magazine compartments 12, 14, 16, 18 are displaceable individually from a working position 24, in which the magazine compartments 14, 16 and 18 are located, into a filling position 24', in which the magazine compartment 12 is located. The displacing drive acting on the shanks 22 is located in the rack 20 and is not shown.

A conveying device 26, which has a multiplicity of grippers 30 fastened at intervals one behind the other on a conveying chain 28, leads away over all the magazine compartments 12, 14, 16, 18, which are retracted into the working position 24. The conveying chain 28 is guided in a known way in a cross-sectionally C-shaped channel 32, which runs in a horizontal and rectilinear direction above the magazine device 10. The conveying device 26 is intended for taking products 36 removed from the magazine compartments 12, 14, 16, 18 by means of transporting members 34 and feeding them to a further processing point which is arranged downstream of the magazine device 10, seen in conveying direction F, and indicated in FIG. 1 by an arrow 38. There, the products 36, which are cards or product samples, are inserted or stuck into printing products, such as for example periodicals, brochures or the like.

Figure 3:
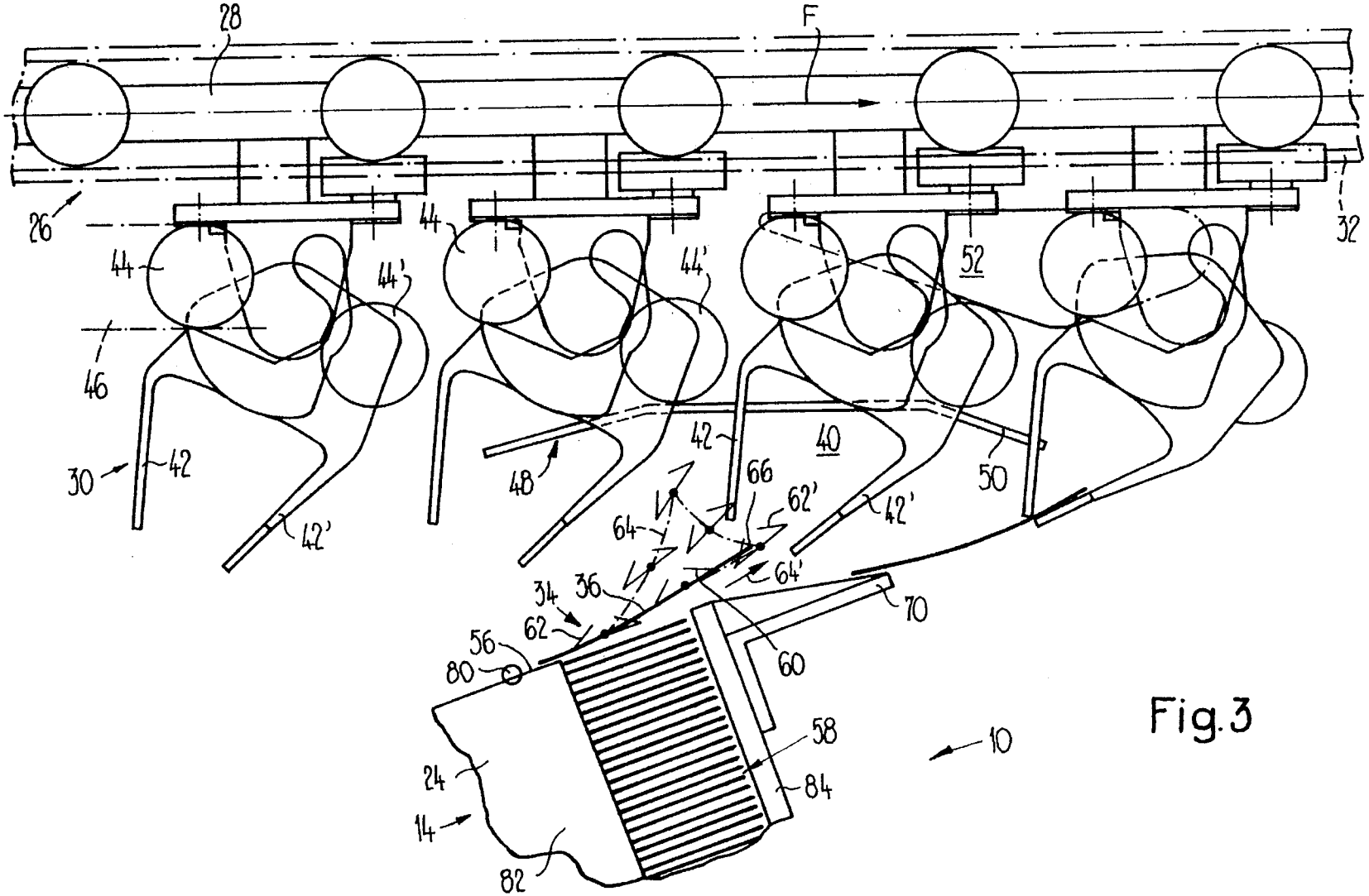
FIG. 3 shows, enlarged in comparison with FIG. 1, part of the apparatus shown in FIGS. 1 and 10 in which a product removed from the magazine compartment is introduced into the mouth of a gripper.

The grippers 30 have two clamping jaws 42, 42', which form a gripper mouth 40, can be swiveled about a joint axis and are each connected via levers to actuating rollers 44, 44'; see in particular FIG. 3. A fixed link 46, which runs above the magazine device 10, parallel to the channel 32, interacts with the actuating rollers 44 and determines the position of one of the clamping jaws 42, 42'. In the Figures, the affected clamping jaw is depicted as being the upper clamping jaw 42, which trails the other clamping jaw when the apparatus is operating in conveying direction F.

Each of the magazine compartments 12, 14, 16, 18 is assigned an independently controllable link arrangement 48, which respectively interact with the actuating rollers 44' in order to transfer the leading, lower clamping jaws 42' into the closing position and to close the gripper mouth 40 when that particular link arrangement 48 is activated. Each of the link arrangements 48 has a lower jointed link rail 50 and, above the latter, a swiveling link wedge 52. If the grippers 30 are not to close, the link rail 50 is located in its lower rectilinear end position and the link wedge 52 is in a swivel-resting position, as is shown in FIG. 1 with reference to the link arrangements 48 assigned to the magazine compartments 12, 16 and 18. The actuating rollers 44' are not actuated in this case. If, on the other hand, the grippers 30 are to close, the link rail 50 is brought into its upper end position and the link wedge 52 is swiveled counterclockwise out of the swivel-resting position into a swivel-working position, as is shown in FIG. 1 with respect to the link arrangements 48 assigned to the magazine compartment 14 and in FIG. 3. The link rail 50 is in this case bent at both ends in a direction obliquely downward to form two ramps. The ramp in the initial region seen in conveying direction F, forms a run-up ramp for the actuating rollers 44' which opens the grippers 30 fully. The second ramp, and the link wedge 52, which has been swiveled into the swivel working position, guide the actuating rollers 44' on both sides. When the actuating rollers 44' run into the link wedge 52, the leading clamping jaws 42', seen in conveying direction F, are swiveled clockwise, in order to close the gripper mouth 40. The clamping jaws 42, 42' are held in the closing position by means of a latching device, which is released at the further processing point 38, so that the grippers 30 release the products 36. Grippers of this type are disclosed, for example, in European Patent Application No. 93100004.6 and the corresponding U.S. patent application No. 08/018,749 and in Swiss Patent Application No. 03694/92-7 and the corresponding U.S. application Ser. No. 08/158,616, now U.S. Pat. No. 5,395,151.

The link rails 50 and link wedges 52 are actuated, for example, by means of cylinder-piston arrangements (not shown), which are driven by a control device 54, which is arranged in the rack 20 and is indicated by an arrow.

The upwardly open magazine compartments 12, 14, 16, 18 have at this end of them a delivery point 56 (FIG. 3). Located at this point in each case is the uppermost outermost product 36 of a stack 58 arranged in the respective magazine compartment 12, 14, 16, 18. The transporting member 34 has a suction head 60, which is intended for seizing in a receiving position 62 at the delivery point 56 the relevant product 36 on its exposed upper side and introducing it into the gripper mouth 40 of an opened gripper 30. For this purpose, the suction head 60 is connected to a drive mechanism, as is disclosed, for example, in Swiss Patent Nos. 598106 and 626589 and the corresponding U.S. Pat. Nos. 4,127,262 and 4,279,412. The suction head 60 is moved by means of the drive mechanism along a closed circulating path 64, the form of which is similar to a hypocycloid. The drive mechanism of this type has a planetary gearing, which is connected to a drive motor and on the planetary gear of which there is eccentrically applied an angle lever, which is guided at one end in a longitudinal guide and on which at the other end the suction head 60 is fastened. In order to achieve the circulating direction indicated in FIG. 3 by arrow 64', the drive motor is to be driven counter to the direction shown in the above-cited documents.

Between the receiving position 62 and transfer position 62' in the path of movement of the gripper 30 in which the relevant product 36 is introduced in the gripper mouth 40, the suction head 60 is connected to a vacuum source (not shown). A valve arrangement suitable for this purpose is disclosed, for example, in Swiss Patent No. 626589 and the corresponding U.S. Pat. No. 4,279,412. The direction of movement of the suction head 60 from the receiving position 62 into the transfer position 62' has a component pointing in conveying direction F and a component pointing upward in the vertical direction from the delivery point 56. As a result, the products 36 are introduced with their leading edge 66, seen in conveying direction F, heading into the gripper mouths 40, which are directed counter to the conveying direction F and obliquely downward.

Figure 4:
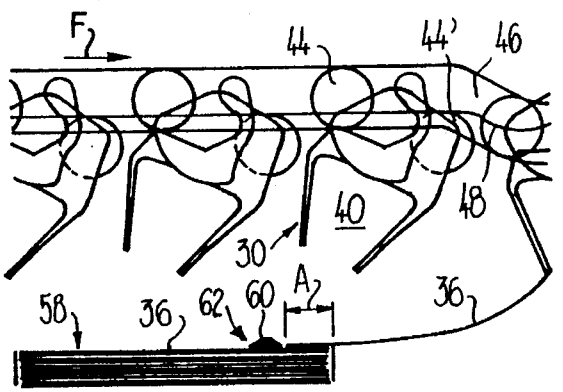
FIGS. 4 to 9 show in a similar representation to FIG. 3 the apparatus according to the invention during the process of drawing off a product from a stack and introducing this product into the mouth of a gripper at six different points in time of a working cycle.
Figure 5:
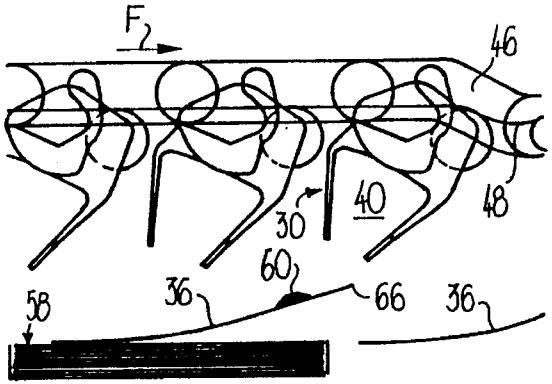
Figure 6:
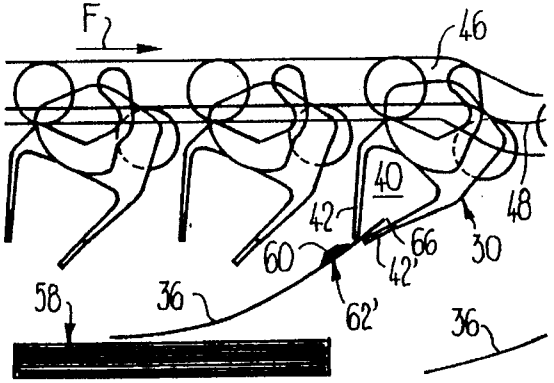
Figure 7:
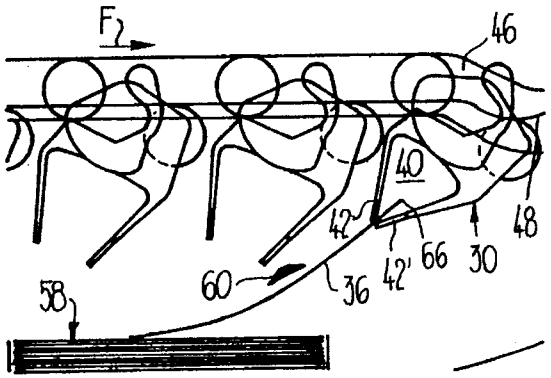
Figure 8:
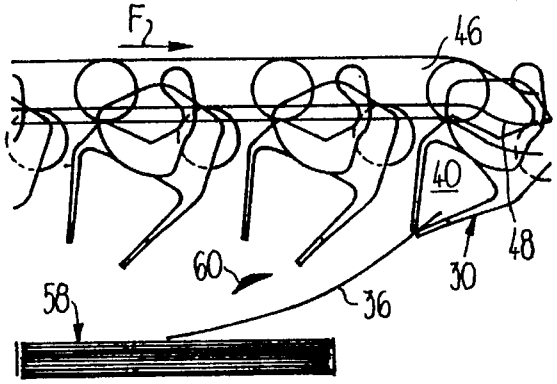
Figure 9:
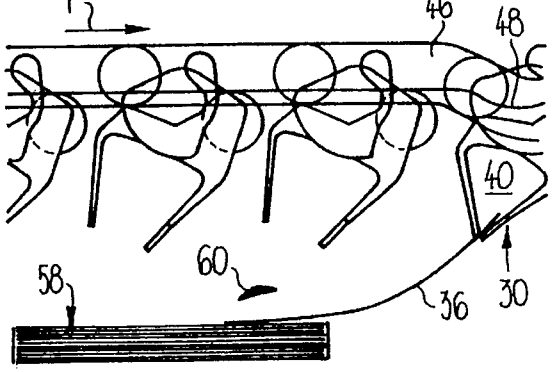

The drawing off of a product 36 from the relevant stack 58 and introduction into the corresponding gripper 30 is now explained in more detail with reference to FIGS. 4–9. The reference symbols used in these figures correspond to those used above. In FIG. 4, the suction head 60 is located in receiving position 62 and is connected to the vacuum source. In this case, it rests on the exposed flat side of the outermost product 36 of the stack 58 and sucks said product to it. In this case, it should be noted that between the leading edge 66 and the suction head 60 there is a distance A which is at least as great as the depth of penetration with which the product 36 then enters into the gripper mouth 40 (see FIG. 6). As FIG. 5 shows, the suction head 60 lifts the uppermost product 36 off the stack 58 and accelerates it simultaneously in conveying direction F. Since the suction head 60 is driven synchronously with the conveying device 26, the product 36 is then introduced with the leading edge 66 ahead into the relevant opened gripper mouth 40, which is then closed by means of the link 46 and the link arrangement 48 (FIG. 6). This happens when the suction head 60 has reached the transfer position 62'. At the same time, the suction pressure is discontinued (such as by disconnecting the suction head from the vacuum source) so that the suction head releases the product 36 (FIG. 7). The product 36 is then transported away by means of the gripper 30, and the suction head 60 moves along the circulating path 64 back in the direction of the receiving position 62, in order to receive the next product 36 (FIG. 8). After the gripper 30 is closed, it is swiveled by the link 46 counterclockwise, as can be seen in particular from FIG. 9. This contributes to the product 36 being accelerated with respect to the circulating speed of the conveying device 26 and thus to the next product 36 being exposed at an early time for the suction head 60 (FIG. 4).

The length of the products 36, measured in conveying direction F or in the direction of movement of the suction head 60, corresponds approximately to the center-to-center distance between two successive grippers 30. If, seen in conveying direction F, larger products 36 are to be processed, additional means are to be provided in order to remove the product 36 respectively seized by a gripper 30 from the region of the stack 58.

Each magazine compartment 12, 14, 16, 18 is assigned pushing means 68, which are designed for supporting the respective stack 58 and for pushing upward in the longitudinal direction of the magazine compartment when the stack 58 is being reduced, so that the upper end of the stack is substantially continuously located at the delivery point 56. On extension arms 70, which are fastened on the rack 20, there is rotatably mounted in each case a pair of spindles 72, which extend in the vertical direction and are connected to a drive motor 74. The two spindles 72 of the pair of spindles interact with a running nut 76, on which a tongue-like pushing element 78 is fastened. When the pushing element 78 is located in its lower-most position (see FIG. 1, the pushing element 78 assigned to the magazine compartment 12), it is arranged underneath the relevant magazine compartment 12, 14, 16, 18 so that the latter can be brought from the working position 24 into the filling position 24' and back again. When the pushing element 78 is raised out of this position by driving the pair of spindles 72, it moves into the magazine compartment 12, 14, 16, 18, comes to bear against the lowermost product 36 of the stack 58 and raises the entire stack 58. Arranged at the upper end of each magazine compartment 12, 14, 16, 18 is a light barrier 80 (FIG. 3), which is connected to the control device 54. The control device 54 in each case sets the drive motor 74 into operation until the light barrier 80 is interrupted by the uppermost product 36 of the stack 58. Then, the drive motor 74 is stopped until the light barrier 80 is cleared again, when the relevant product 36 has been drawn off from the stack 58 by means of the transporting member 34. The position of the stack 58 is consequently automatically leveled in such a way that the uppermost product 36 is located at the delivery point 56. Once the stack 58 of a magazine compartment 12, 14, 16, 18 has been reduced, the pushing element 78 is brought into its lower end position and the relevant magazine compartment 12, 14, 16, 18 is moved into the filling position 24', where it is freely accessible in order to be provided again with a new stack 58.

As is evident in particular from FIG. 2, the magazine compartments 12, 14, 16, 18 have compartment walls 82, arranged in a U-shaped manner, and are open on the side facing the respective pair of spindles 72. The pair of spindles 72 is in each case arranged after the relevant magazine compartment 12, 14, 16, 18 in conveying direction F. In working position 24 of the magazine compartments 12, 14, 16, 18, the products 36 are prevented from falling out by retaining rails 84, which are arranged fixedly between the pair of spindles 72 and its mating magazine compartment 12, 14, 16, 18 and the pushing element 78 passes through the retaining rails 84.

To support a stack 58 introduced into a magazine compartment 12, 14, 16, 18, when the magazine compartment is located in filling position 24', each of the mutually opposite compartment walls 82 has at its lower end bottom plates 86, which protrude in the direction of the compartment interior and are spaced apart. The bottom plates 86 are spaced sufficiently far apart that when the magazine compartment is in working position 24 the pushing element 78 can move between them.

Figure 10:
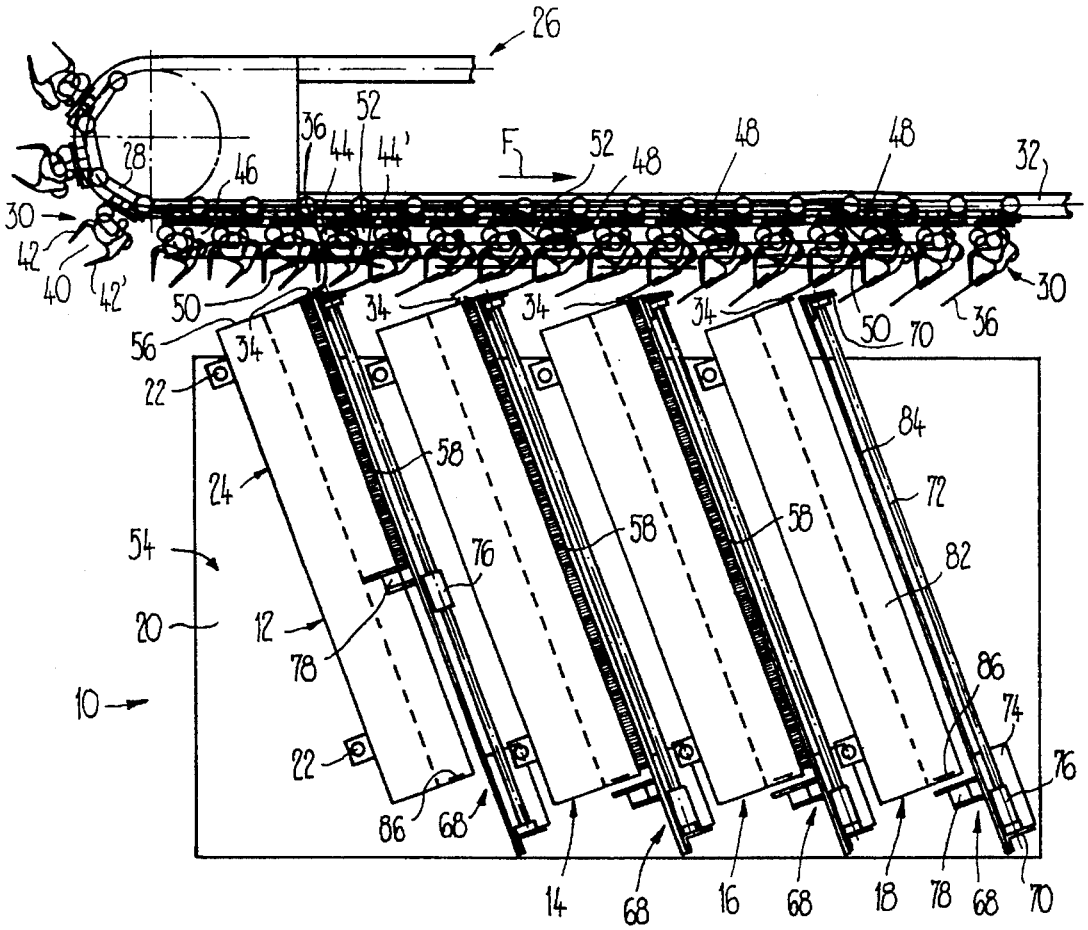
FIG. 10 shows in elevation a further embodiment of the apparatus according to the invention, similar to the embodiment shown in FIG. 1, with the magazine compartments being arranged in an inclined manner.

FIG. 10 shows a further embodiment of the apparatus according to the invention similar to the embodiments described above. The major difference is that the magazine compartments 12, 14, 16, 18 and the pairs of spindles 72 assigned to the latter are arranged in a rearwardly inclined manner on the rack 20, so that in each case the delivery point 56 is offset counter to the conveying direction F with respect to a vertical line through the lower end of the magazine compartment 12, 14, 16, 18. The flat side of the products 36 in this case runs approximately in the direction of movement of the suction head 60 from the receiving position 62 into the transfer position 62'.

Figure 11:
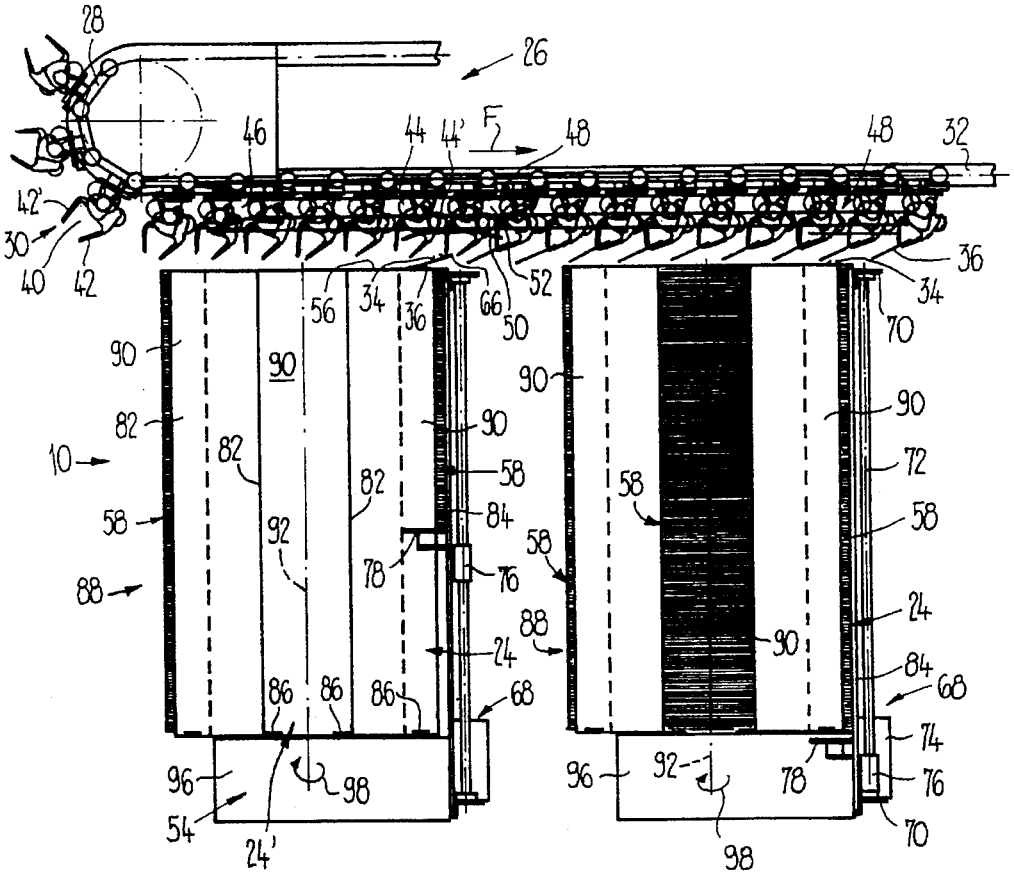
FIGS. 11 and 12 show in elevation and plan view, respectively, a further embodiment of the apparatus according to the invention with two magazine units in which four magazine compartments are in each unit arranged in a tower-like manner around a vertical axis of rotation.
Figure 12:
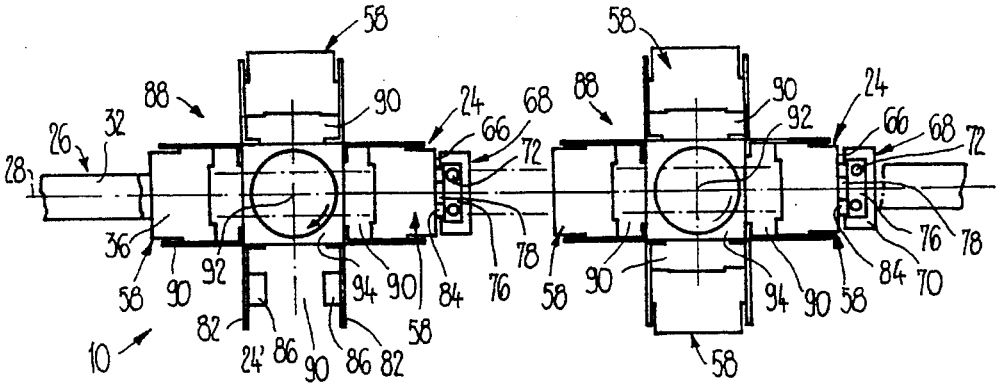

A further embodiment of the apparatus according to the invention is represented in FIGS. 11 and 12. The magazine device 10 has in this case two magazine units 88, which are arranged one behind the other along the conveying device 26 and to each of which a transporting member 34 and a pushing means 68 are assigned. These are of the same design as in the embodiments described above. Each magazine unit 88 has four magazine compartments 90 which are in each case fastened in a stellar manner on a pivot mounting 94, which is rotatable about its longitudinal axis 92 running in the vertical direction. Said mounting is mounted in a base 96 and is connected to a rotary drive, which can be driven by control device 54 as symbolized by the arrows 98. Also fastened on the base 96 are the retaining rails 84 and the drive motor 74. A pair of spindles 72 is mounted at the upper end on an extension arm 70, fastened on the retaining rails 84, and at the lower end on an extension arm 70, supported on the base 96.

The magazine compartment 90 respectively facing the pushing means 68 is located in working position 24 and is ready for reduction of its held stack 58. Reduction is performed in precisely the same way as described above. Once a stack 58 has been reduced, the pushing element 78 is brought into the lower end position and the magazine compartments 90 of the relevant magazine unit 88 are turned clockwise 90° by means of the rotary drive 98 about the axis of rotation 92, as is represented with reference to the magazine unit 88, shown on the left in FIG. 12. The empty magazine compartment 90 shown there is located in freely accessible filling position 24'. During the time in which the magazine compartment 90 located in working position 24 is being emptied, the magazine compartment 90 located in filling position 24' is provided with a new stack 58, as was the case with reference to the magazine unit 88 shown on the right in FIG. 11.

Figures 13, 14:
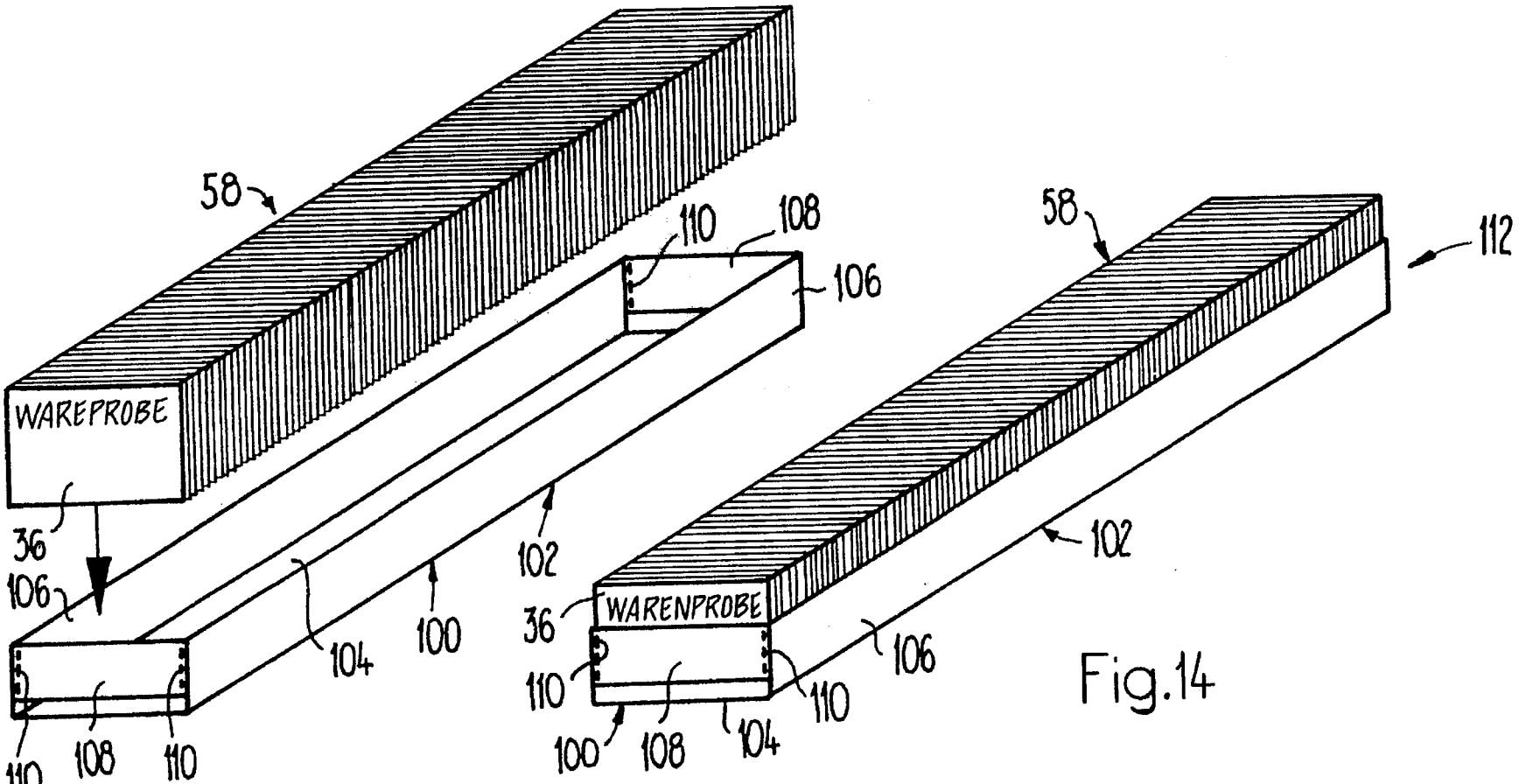
FIG. 13 shows in perspective representation a stack of products which is inserted into a box-like container to form a product supply unit.
FIG. 14 likewise shows in perspective representation a product supply unit.

To expedite filling of the magazine compartments, a stack 58 of products 36 can be placed into a box-like container 100, as FIG. 13 shows. The container 100 is designed as a lidless cardboard box 102. It has a bottom 104 and two side walls 106, running in the longitudinal direction of the stack 58. In the embodiment shown in FIGS. 13–15, the end walls 108, running transversely to the longitudinal direction of the box, are designed as webs which are at a distance from the bottom 104 and interconnect the two side walls 106. Provided at the connection points between the side walls 106 and the end walls 108 are perforations 110 to allow the end walls 108 to be separated from the remaining part of the cardboard box 102.

FIG. 14 shows a product supply unit 112, which comprises a cardboard box 102 and the stack 58 received in it. The magazine compartments 12, 14, 16, 18, 90 are preferably designed for each to be able to receive such a product supply unit 112. Upon inserting a product supply unit 112 into a magazine compartment 12, 14, 16, 18, 90, the end walls 108 of the product supply unit are removed so that the outermost product 36 of the stack 58 is freely accessible to the transporting member and so that the pushing element 78 can engage the outermost product at the opposite end of the stack 58. Through the use of such product supply units 112, extremely quick filling of the magazine compartments 12, 14, 16, 18, 90 can be obtained without problem. Moreover, the product supply units 112 can be stacked into stable stacks both for delivery and for storage, as shown in FIG. 15.

Figure 15:
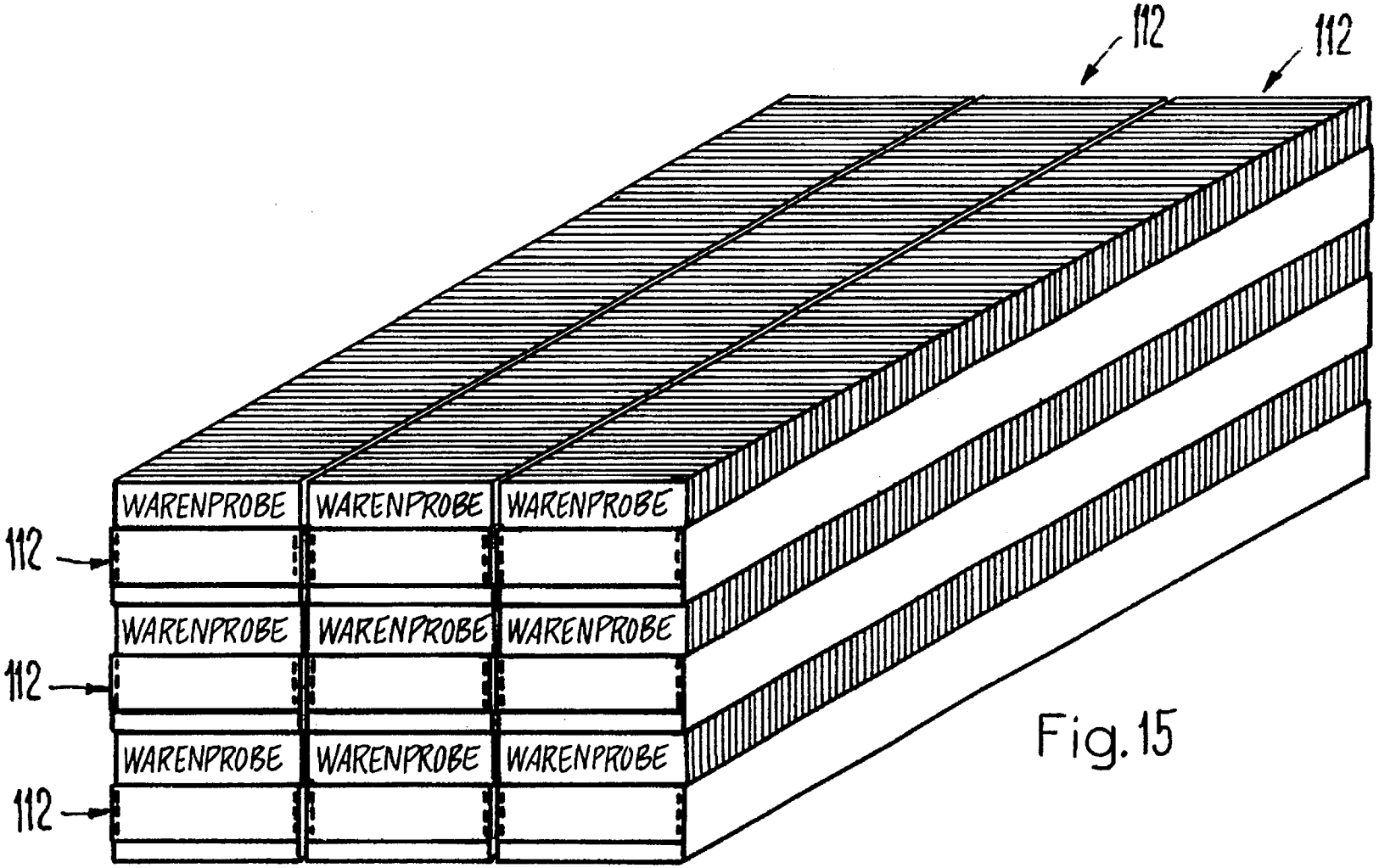
FIG. 15 shows in perspective representation a supply stack of product supply units.

In the product supply units 112 shown in FIGS. 13–15, the products 36 extend beyond the side and end walls 106, 108. It would also be conceivable to take these walls up to the upper edge of the horizontal stacks 58. Furthermore, the containers 100 could be made, for example, from plastic or sheet metal, the end walls then being arranged such that they could be taken away, swiveled away or pushed away.

The mode of operation of the apparatuses described above is as follows:

First of all, with pushing elements 78 located in the lower end position, the magazine compartments 12, 14, 16, 18, 90 are each filled with a stack 58 of products 36. In the case of the embodiments according to FIGS. 1 to 10, this takes place by the magazine compartments 12, 14, 16, 18 being successively extended into the filling position 24' one after the other and, after filling, being withdrawn again into the working position 24. In the case of the embodiment shown in FIGS. 11 and 12, the magazine compartments 90 are brought one after the other into the filling position 24' by turning a magazine unit about its axis of rotation 92 and, after filling, continuing to turn in 90° increments until all the magazine compartments 90 have been filled. After filling and returning to working position 24, the magazine compartments 12, 14, 16, 18, 90 are entered from below by the pushing element 78, which is moved by driving the pairs of spindles 72. The stack 58 is raised until the respectively uppermost product 36 is located at the delivery point 56. The magazine device 10 is then ready for delivering products 36.

After setting the conveying device 26 into operation, the removal of products 36 from one of the magazine compartments 12, 14, 16, 18, 90, located in working position 24, then begins. The link arrangement 48 assigned to the relevant magazine compartment is activated and the corresponding transporting member 34 is set in motion as shown in FIG. 1: magazine compartment 14, FIG. 10: magazine compartment 12, and FIG. 11: the magazine compartment 90 located in the working position of the magazine unit 88 shown on the left. During a certain time period, products 36 are then removed one after the other from the relevant magazine compartment 12, 14, 16, 18, 90 by means of the transporting member 34 and are introduced into the successive grippers 30 of the conveying device 26. After this time period, which may last, for example, until the relevant magazine compartment 12, 14, 16, 18, 90 is empty, the control device 54 switches the previously activated link arrangement 48 over into the resting position and switches off the relevant transporting member 34. To avoid interruptions, again during a time period the products 36 are then removed from another magazine compartment 12, 14, 16, 18, 90, located in working position 24. The activation of the relevant link arrangement 48 and of the transporting member 34 is performed appropriately in-phase by the control device 54, so that the first gripper 30 following a gripper 30 which has previously been fed a product 36 is now fed a product 36 from the subsequently activated magazine compartment. If the magazine compartment 12, 14, 16, 90, which is subsequently activated, is located upstream (counter to the conveying direction F) with respect to that magazine compartment 14, 16, 18, 90 from which the products 36 have previously been removed, the control device 54 activates the relevant link arrangement 48 and the relevant transporting member 34 corresponding to the upstream magazine compartment before the link arrangement 48 and the relevant transporting member 34 of the downstream magazine compartment are switched over into the resting position. This is quite possible for the control device 54, provided that it detects the number of products 36 respectively located in the magazine compartments 12, 14, 16, 18, 90 and the number of grippers 30 between the transfer points 62' of the transporting members 34 assigned to the various magazine compartments 12, 14, 16, 18, 90. In this way, the stacks 58 are reduced alternately.

Once a magazine compartment 12, 14, 16, 18, 90 has been emptied, it is transferred for filling into the filling position 24'.

To be able to operate without interruption, at least two magazine compartments are necessary, each with a transporting member 34. If, as shown in FIGS. 1, 2 and 10, the apparatus has four magazine compartments 12, 14, 16, 18, two of the magazine compartments could be filled with a stack 58 of a first type of products 36 and the other two magazine compartments could each be filled with a stack 58 of a second type 36. Uninterrupted operation is ensured then as well, and it is thus possible to process at the further processing point 38 for a lengthy processing phase the same type of products 36 or to alternate between product types so that, after a certain number of one particular type the apparatus can then process products 36 of the other type. If, on the other hand, all four stack compartments 14, 16, 18, 20 are provided with the same products, the supply is increased, so that in each case two or three of the magazine compartments can be filled shortly one after the other and then a lengthy time is available until two to three magazine compartments have again been emptied. The same advantages are accomplished by the embodiment according to FIGS. 11 and 12. Thus, it is quite possible for all the magazine compartments 90 of the one magazine unit 88 to be emptied before they have to be filled again.

It should be mentioned for the sake of completeness that, seen in conveying direction F, the suction heads 60 may be arranged laterally of the path of movement of the grippers 30. The suction heads may in this case also take hold of the products 36 at their leading edge 66. It is also conceivable to provide on each of both sides of this path of movement a suction head 60 in order to seize the products 36 with two suction heads 60. Moreover, it is possible to assign to each transporting member 34 a plurality of suction heads 60, which each grip a product 36 alternately one after the other and feed it to a gripper 30. Finally, it should be mentioned that the transporting members 34 or suction heads 60 may be driven in different ways from those described.

It is also conceivable to provide instead of the pair of spindles 72 only one spindle and a guide for preventing turning of the running nut. In addition, the light barrier 80 may be replaced by other types of switching means.

Further, a plurality of magazine compartments may be arranged on an endless drawing member, for example a chain, and that said chain is in each case driven to bring a magazine compartment into the working position.

That which is claimed is:

1. An apparatus for feeding products from a stack to a processing point comprising:

a magazine device having at least two magazine units, each of said magazine units having a plurality of magazine compartments for receiving a stack of products and with the magazine units each being mounted on a base which is rotatable about an axis of rotation so that said magazine compartments each can be rotated between a working position and a filling position, and a conveying device extending serially across each of said magazine compartments of said at least two magazine units which are located at said working position and to a further processing point, wherein said conveying device includes a plurality of grippers which are arranged one behind the other on a drawing member which is driven in a conveying direction between said magazine device and said further processing point, and wherein each of said grippers has a gripper mouth which is movable between open and closed positions, and means for effecting individual movement of said grippers between said open and closed positions, and a transporting member assigned to each of said magazine compartments of said at least two magazine units which are located at said working position and wherein each of said transporting members is movable from a receiving position located adjacent its assigned magazine compartment to a transfer position located proximate the path of movement of said grippers and back to said receiving position and wherein each of said transporting members is capable of removing a product from said stack of products placed in its assigned magazine compartment and transporting said product from said receiving position to said transfer position and then releasing said product to one of said plurality of grippers, pushing means assigned to each of said magazine compartments of said at least two magazine units which are located at said working position and for pushing stacks of products placed in said magazine compartments in a direction towards said conveying device, and control means for selectively operating each of said transporting members so as to continuously deliver products to the conveying device from said magazine compartments located at their respective working positions and without interruption.

2. The apparatus as defined in claim 1 wherein said control means acts to selectively 1) serially remove products from one of said magazine compartments located at its working position and deliver the removed products to successive grippers of said conveying device, and 2) serially remove products from another one of said magazine compartments located at its working position and deliver the removed products to successive grippers of said conveying device, whereby an interruption of the delivery of the products to the grippers of said conveying device may be avoided during periodic filling of the magazine compartments.

3. The apparatus as claimed in claim 2, wherein said grippers are further arranged on said drawing member so that their gripper mouths are aligned pointing obliquely downward and in a direction opposite that of the conveying direction and wherein the path of motion of each of said transporting members from the receiving position to said transfer position is in a direction which has a component in the conveying direction and a component from the magazine device towards the conveying device.

4. The apparatus as claimed in claim 2, wherein said pushing means includes a pushing element for entering a magazine compartment, engaging a product stack behind the product of the stack furthest away from the transporting member receiving position and moving said product stack so as to align the product stack with said transporting member receiving position.

5. The apparatus as claimed in claim 4, wherein said pushing element is connected to a running nut which is seated on a spindle, and wherein said spindle extends in a direction substantially parallel to a longitudinal direction of said magazine compartments, and wherein said spindle is connected to a drive motor.

6. The apparatus as claimed in claim 2, wherein said magazine compartments are movable from a working position proximate said transporting member receiving position to a filling position.

7. The apparatus as claimed in claim 2, wherein said magazine compartments extend in a vertical direction perpendicular to said conveying direction.

8. The apparatus as claimed in claim 2, wherein said conveying device runs in a substantially rectilinear path in a substantially horizontal direction over said magazine device.

9. The apparatus as claimed in claim 2, wherein each of said transporting members has a suction head which is connected at times to vacuum source means for enabling said transporting member to seize a product from a product stack placed in the magazine compartment and hold the product while it is moved from said receiving position to said transfer position.

10. The apparatus as claimed in claim 2, further comprising a product stack placed in at least one of said magazine compartments, wherein the products of said product stack are dimensioned, when measured in the conveying direction, so as to be less than or equal to the center-to-center distance between two successive grippers.

11. The apparatus as claimed in claim 2, further comprising a product supply unit placed in at least one of said magazine compartments, wherein said product supply unit comprises a box-like container containing a stack of products.

12. The apparatus as claimed in claim 11, wherein said box-like container has two longitudinal side walls and first and second end walls connecting said two longitudinal walls, wherein said first and second end walls are removable.

* * * * *